US008727028B2

(12) United States Patent
Johnson

(10) Patent No.: US 8,727,028 B2
(45) Date of Patent: May 20, 2014

(54) PLUGGING A MINED-THROUGH WELL

(75) Inventor: Rick D Johnson, Fort Smith, AR (US)

(73) Assignee: Effective Exploration, LLC, Dallas, TX (US)

( * ) Notice: Subject to any disclaimer, the term of this patent is extended or adjusted under 35 U.S.C. 154(b) by 0 days.

(21) Appl. No.: 13/269,455

(22) Filed: Oct. 7, 2011

(65) Prior Publication Data

US 2012/0199348 A1 Aug. 9, 2012

Related U.S. Application Data

(63) Continuation of application No. 12/109,277, filed on Apr. 24, 2008, now Pat. No. 8,033,337.

(60) Provisional application No. 60/950,321, filed on Jul. 17, 2007.

(51) Int. Cl.
*E21B 33/127* (2006.01)
*E21B 41/00* (2006.01)
*E21B 33/12* (2006.01)

(52) U.S. Cl.
CPC ..... *E21B 41/0042* (2013.01); *E21B 33/12* (2013.01)
USPC ..... 166/387; 166/285; 166/386

(58) Field of Classification Search
CPC combination set(s) only.
See application file for complete search history.

(56) References Cited

U.S. PATENT DOCUMENTS

| | | | | |
|---|---|---|---|---|
| 3,927,719 | A | 12/1975 | Maser | |
| 4,000,621 | A * | 1/1977 | Maser | 405/269 |
| 4,165,903 | A | 8/1979 | Cobbs | |
| 4,458,945 | A | 7/1984 | Ayler et al. | |
| 4,653,597 | A | 3/1987 | Johnson | |
| 5,868,210 | A | 2/1999 | Johnson et al. | |
| 2003/0085037 | A1 | 5/2003 | Roane et al. | |
| 2003/0205379 | A1 | 11/2003 | Steele et al. | |
| 2004/0035581 | A1 | 2/2004 | Cavender | |

OTHER PUBLICATIONS

Notification of International Search Report and the Written Opinion of the International Searching Authority, or the Declaration (3 pages), International Search Report (3 pages), and Written Opinion of the International Searching Authority (7 pages) for International Application No. PCT/US2008/061458 mailed Dec. 18, 2008.

* cited by examiner

*Primary Examiner* — Zakiya W Bates
(74) *Attorney, Agent, or Firm* — Fish & Richardson P.C.

(57) ABSTRACT

A system and method of plugging a well bore includes intersecting a portion of a well with a subterranean cavern. A portion of the well may be isolated to prevent accumulation of reservoir fluids in the subterranean cavern by, for example, inserting a packer in the well to form a seal. A sealing material may be pumped into and allowed of solidify in the portion of the well to form a partition between the subterranean cavern and the remainder of the well. The formed partition permits continued production from the well and continued mining in the subterranean cavern.

11 Claims, 6 Drawing Sheets

PLUGGING A MINED-THROUGH WELL

CROSS REFERENCE TO RELATED APPLICATIONS

This application is a continuation (and claims the benefit of priority under 35 USC 120) of U.S. application Ser. No. 12/109,277, filed Apr. 24, 2008, which claims the benefit of U.S. Provisional Application No. 60/950,321, filed Jul. 17, 2007, which is incorporated herein by reference in its entirety.

TECHNICAL FIELD

This invention relates to plugging a well, and particularly to plugging a portion of a well system to isolate the portion of the well system from the remainder of the well system.

BACKGROUND

In certain instances, a well or a portion of a well may pass through a subterranean zone, such as a mineral deposit or other formation, that is being mined. As mining progresses, the mine may eventually be extended to pass through the well. However, it is often unsafe or otherwise undesirable for the well to communicate with the mine. For example, if a well collecting natural gas from a natural gas bearing formation were allowed to communicate with a mine, the natural gas may migrate from the formation into the mine and create an explosive atmosphere or otherwise create a harmful environment to occupants of the mine. Therefore, to prevent the potentially unsafe conditions, the well is typically shut in or otherwise permanently abandoned. It is often undesirable to shut in the well, for example, because the well may reach other portions of the subterranean zone or other subterranean zones that are not being mined or the well may be desired to be used for other purposes.

SUMMARY

One aspect of plugging a well bore encompasses intersecting the well bore and a subterranean mine and depositing a seal through the intersection of the well bore and subterranean mine to isolate a portion of the well bore.

Another aspect encompasses forming a vacuum in the well, depositing a seal through an intersection of the well and subterranean mine to isolate a portion of the well from the subterranean mine, and producing a fluid from the well.

A further aspect encompasses a system for isolating a portion of a well bore. The system may include a packer disposed in the portion of the well bore, a well bore segment formed between the packer and an intersection of the well bore and a subterranean mine, an casing extending into a length of the well bore segment from the subterranean mine, an end piece coupled to the casing at a sub-surface end thereof, the end piece comprising an orifice, and a tubing string operable to inject a sealing material from the subterranean and into the well bore segment.

The various aspects may include one or more of the following features. A perimeter of a well bore may be expanded. Also, expanding the perimeter of the well bore may include inserting a plug into the well bore from the subterranean mine, enlarging the perimeter of the portion of the well bore, and removing the plug from the well bore through the subterranean mine. A portion of the well bore may be cased. Depositing a seal through the intersection of the well bore and subterranean mine to isolate a portion of the well bore may include inserting a packer into the portion of the well bore from the subterranean mine. A packer may be fixed into a desired location within the portion of the well bore. Further, fixing the packer into a desired location within the portion of the well bore may include inflating the packer to form a seal. Depositing a seal through the intersection of the well bore and subterranean mine to isolate a portion of the well bore may include injecting a sealing material into the portion of the well bore from the subterranean mine. Additionally, the injected sealing material within the well bore may be pressurized. Depositing a seal through the intersection of the well bore and subterranean mine to isolate a portion of the well bore may include portioning the well bore to form the portion of the well bore, injecting a first sealing material into the portion of the well bore to form a plug, and injecting a second sealing material into the portion of the well bore adjacent to the plug. The first sealing material and the second sealing material may be different.

The various aspects may further include one or more of the following features. Forming a vacuum in the well may include generating a low pressure within the well bore near the surface, and the generated low pressure may induce a flow from the subterranean mine to the portion of the well. Depositing the seal through an intersection of the well and subterranean mine to isolate a portion of the well from the subterranean mine may include inserting a packer from the subterranean mine into a lateral well bore of the well proximate a kickoff point, securing the packer within the lateral well bore, and injecting a sealing material through the subterranean mine into the lateral well bore. Injecting the sealing material through the subterranean mine into the lateral well bore may include injecting the sealing material into the lateral well bore through a tubing string extending from the subterranean mine and filling an annulus formed between the lateral well bore an the tubing string with the sealing material. Also, a pressure may be applied to the injected sealing material for a selected period of time. Further, the packer may be secured within the lateral well bore by inflating the packer to form a seal. Securing the packer within the lateral well bore may include inflating the packer to form a seal. Expanding the portion of a perimeter of a lateral well bore of the well may include inserting a plug into the lateral well bore from the subterranean mine, enlarging the perimeter of the portion of the lateral well bore, and removing the plug from the lateral well bore through the subterranean mine. The subterranean mine may be expanded concurrent with producing the fluid from the well.

The various aspects may additionally include one or more of the following features. A vacuum pump may also be disposed at a surface of the well and operable to generate a lower pressure in the well than in the subterranean mine. The end piece may include a well head operable to inject a fluid into the well bore portion from different sized pipe. The packer may be an inflatable packer, and the system further include a parasite tube coupled to the inflatable packer and operable to one of inflate or deflate the packer.

The details of one or more implementations of the present disclosure are set forth in the accompanying drawings and the description below. Other features, objects, and advantages will be apparent from the description and drawings, and from the claims.

DETAILED DESCRIPTION

In accordance with the concepts described herein, a portion of well that will be mined through can be plugged to substantially reduce and/or prevent communication of fluids from the well into the mine while leaving the remainder of the well intact and functional. In instances where the well has multiple well bores, fewer than all or all of the well bores can be plugged to substantially reduce and/or prevent communication of fluids into the mine. For example, the mine may eventually be extended to pass through fewer than all of the well bores, in which case it may be desirable to plug only those well bores that will be mined through. In certain instances, the remaining well bores may be left to allow the well to continue producing or to be used for other purposes, such as venting reservoir fluids to the atmosphere or flaring the reservoir fluids brought to the surface. Additionally, the present disclosure may be applicable to wells that remove reservoir fluids from a reservoir using artificial lifting or to wells that do not use artificial lifting.

Figure 1:
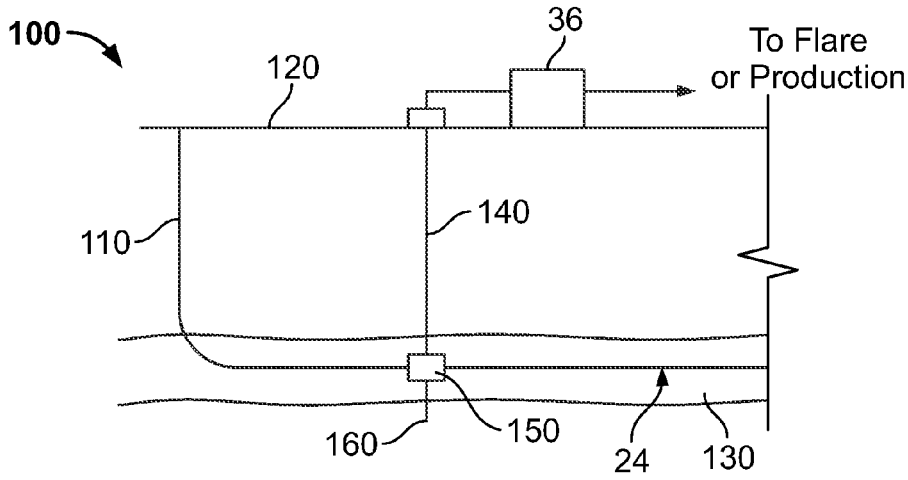
FIG. 1 shows an example well configuration according to some implementations.
Figure 2:
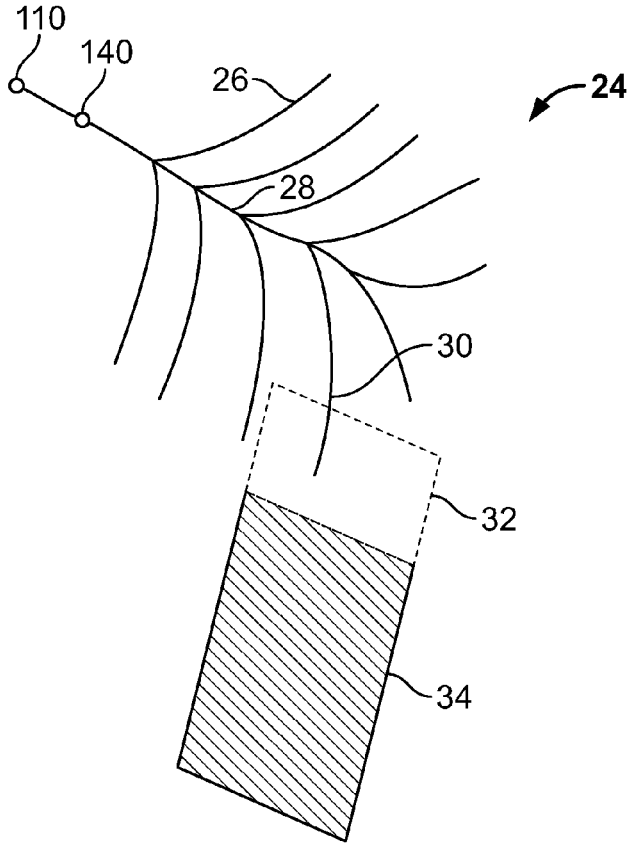
FIG. 2 shows a plan view of the well of FIG. 1, including a well bore pattern in which a lateral well bore extends into a zone to be mined.

Referring to FIG. 1, an example plugging method is described with respect to a horizontal multilateral well 100. The example well 100 includes an articulated well bore 110 that extends from the terranean surface 120 and deviates to substantially horizontal to track a subterranean zone 130. The example well 100 also includes a second well bore 140 that extends from the surface 120 into and/or through the subterranean zone 130, and which the articulated well bore 110 intersects. In certain instances, the subterranean zone 130 is a coal seam. The second well bore 120 includes an enlarged cavity 150 and a sump 160 that may be used to collect liquids and sediment from the subterranean zone 130. In certain instances, the enlarged cavity 150 and/or sump 160 can be omitted. As is seen in FIG. 2, the articulated well bore 110 is coupled to a well bore pattern 24 that includes a plurality of lateral well bores 26 extending from a main well bore 28. Although shown with ten lateral well bores 26, the well bore pattern 24 can be provided with fewer or more lateral well bores 26. For example, the well bore pattern 24 can be provided with two or more lateral well bores 26. Also, in certain instances, the main well bore 28 can be omitted. In certain instances, a portion of the articulated well bore 110 and/or one or more of the lateral well bores 26 may follow the dip of the subterranean zone 130.

Although the example plugging method is described with respect to a horizontal multilateral well bore 100, it is important to appreciate that the plugging method described herein is applicable to other configurations of wells. For example, some or all of the articulated well bore 110 and/or second well bore 140 can be slanted and/or the second well bore 140 may be omitted.

As shown in FIG. 2, a lateral well bore 30 of the well bore pattern 24 intersects a proposed mining area 32. In the present example, mining is continued in the proposed mining area 32 until the mined area (interchangeably referred to as the "mine") 34 intercepts the lateral well bore 30 at an end thereof. However, in other instances, the mined area 34 may intercept the lateral well bore 30 at any location along a length of the lateral well bore 30. When the lateral well bore 30 is intercepted, the well bore pattern 24 is in communication with the mined area 34. At or before this point, a vacuum may be generated within the well bore pattern 24, such as by a vacuum pump or compressor (hereinafter referred to as "vacuum pump") 36 located at the surface 120. The vacuum may be sufficient to draw the production fluids present in the subterranean zone 130 and well bore pattern 24 to the surface to substantially reduce or prevent the production fluids from being introduced into the mined area 34. A flame arresting device to arrest a fire in the well 100 and an automatic flare stack may also be provided. The automatic flare stack may be used to flare gases produced from the well 100. For example, if the vacuum pump 36 fails to produce a vacuum the produced gases may be flared. Alternately, if an oxygen content of the produced gases are above a selected level, the produced gasses may be flared.

As shown in FIG. 1, the vacuum pump 36 is in communication with the second well bore 140. However, the vacuum pump 36 may be in communication with the articulated well bore 110. For example, the vacuum pump 36 may be in communication with the articulated well bore 110 if a second well bore 140 is not present, although the vacuum pump 36 may be in communication with the articulated well bore 110 even if the second well bore 140 is present. Further, the vacuum pump 36 may be installed at the surface 120 prior to intersection of the mined area 34, and the vacuum created by the vacuum pump 36 may be created before the intersection of the mined area 34 and the lateral well bore 30 occurs. According to certain implementations, the vacuum may be maintained at to produce a pressure of between eight inches of mercury and 24 inches of mercury, although other vacuum pressures may be used. For example, vacuum pressure above 24 inches of mercury or below eight inches of mercury may be used.

An oxygen ($O_2$) sensor may also be used to monitor an oxygen level in the production fluid removed from the multilateral well bore 100. The oxygen sensor may be used to detect an amount of oxygen in fluids being produced from the well 100. An excess of oxygen in the produced fluid, such as natural gas, may produce a dangerous, explosive condition. One or more oxygen sensors may also be included in the mine 34.

Figure 3:
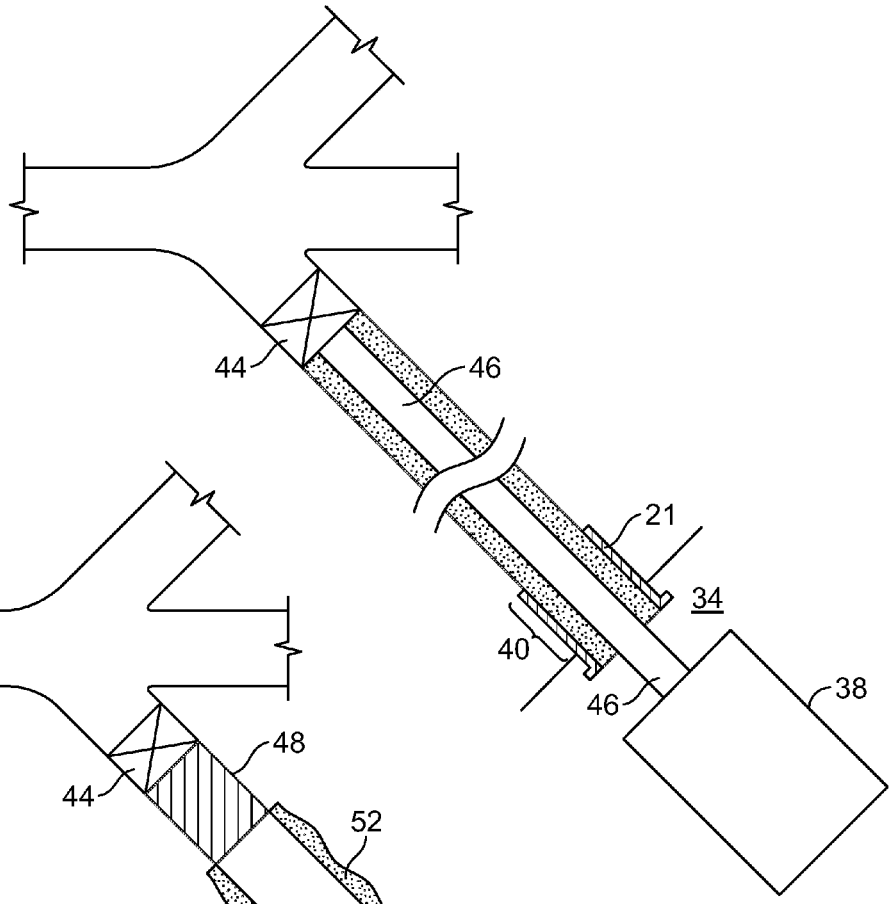
FIG. 3 is a detailed view of a lateral of the well bore pattern of FIG. 2 intersected by a mining operation.
Figure 4:
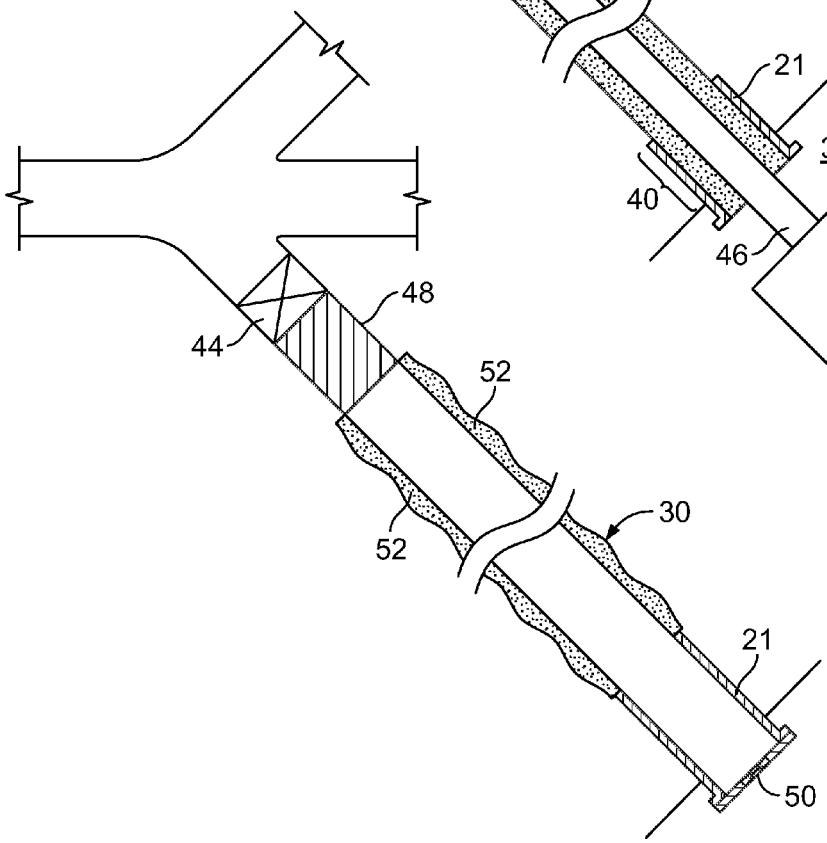
FIG. 4 is the lateral of FIG. 3 in a plugged condition.

FIGS. 3 and 4 show the mine 34 intersecting the lateral well bore 30. A temporary plug may be inserted into the lateral well bore 30 after interception by the mine 34. In certain instances, the temporary plug may be a pipe pig, such as a foam or other type pipe pig. The temporary plug may be inserted from the mine 34 into the lateral well bore 30 to temporarily seal against flow of fluids from the lateral well bore 30 into the mine 34. For example, in certain instances, the lateral well bore 30 is temporarily sealed after being mined through while equipment for the plugging procedure is moved into place in the mine 34.

In certain instances, an in-mine drill rig 38 located in the mine 34 may be used to ream a portion 40 of the lateral well 30 proximate the mine 34. As a result of reaming, the portion 40 is enlarged to accept a conductor casing 21. It is noted that, although Table 1, below, indicates that the conductor casing 21 and the tubing 22 are formed from PVC pipe, the conductor casing 21 and the tubing 22 may be formed from any material, such as a composite material (e.g., concrete, fiber reinforced epoxy composites, etc.), other types of plastics (e.g., polyethylene, etc.), or any other non-sparking material. The portion 40 may be enlarged such that, when a conductor casing 21 is inserted thereinto, an inner diameter of the conductor is substantially the same as or larger than the diameter of the remainder of the lateral well bore 30. However, reaming a portion of the lateral well bore 30 is not required, and a conductor casing may be placed in the portion 40 of the lateral well bore 30 without reaming. Once the conductor casing 21 is placed within the lateral well bore 30, the conductor casing 21 may be fixed into position, such as by cementing or grouting. Thereafter, if a temporary plug is used, the temporary plug may be withdrawn.

The in-mine drill rig 38, if provided, may be used to ream the remainder of the lateral well bore 30. A packer 44 may be positioned in the lateral well bore 30 proximate a kick off point, i.e., the location where the lateral well bore 30 extends from the main well bore 28. In other instances, the packer 44 may be inserted into the lateral well bore 30 at any desired location therein. For example, the packer may be inserted into the lateral well bore 30 at a position uphole from a portion of the lateral well bore 30 that will be intersected by further enlargement of the mine 34. Further, although placement of the packer 44 is described below as being performed from the mine 34, it is understood that the packer 44 may be inserted and/or set into position from the surface 120. The packer 44 may be any type of packer. In one example, the packer 44 may be an inflatable packer.

According to certain implementations, the packer 44 may be attached to a drill rod 46 via a releasable connection (e.g., J-lock or other connection). However, the packer 44 may be inserted into the lateral well bore 30 via any string, such as a working string or drilling string. The drill rod 46 and packer 44 may be extended from the mine 34 and into the lateral well bore 30 via the in-mine drill rig 38. When the packer is located proximate to the kick off point or other desired location, the packer 44 is inflated. Once the packer 44 is inflated, the packer 44 seals a portion of the lateral well bore 30 in communication with the mine 34 from the remainder of the well bore pattern 24. The packer 44 may then be released from the drill rod 46 by decoupling the releasable connection. According to other implementations, the packer 44 may be inserted into the lateral well bore 30 by hand. For example, the packer 44 may be attached to a rod or tube and manually driven into the lateral well bore 30 for placement. According to certain implementations, the packer 44 may be attached to tubular polyvinylchloride ("PVC") pipe and inserted into the well manually. Alternately, other types of tubing may be used to insert the packer 44 into the lateral well bore 30. For example, tubing formed from fiber-reinforced composite materials (e.g., fiberglass, carbon fiber, Kevlar, etc.), other types of polymers (e.g., polyethylene, etc.), or any other type of non-sparking material may be used.

In instances where the packer 44 is an inflatable type, the packer 44 may be coupled to a gas source via a auxiliary tubing coupled to the pipe or rod used to deposit the packer 44 in the lateral well bore 30. The auxiliary tubing may be secured to the pipe or rod. The packer 44 may be inflated by passing a gas through the auxiliary tubing. In certain instances, the gas used for inflating the packer may be an inert gas, for example, to reduce the risk of explosion.

Referring specifically to FIG. 4, the packer 44 may be disconnected from the drill rod 46, and the drill rod 46 may be backed out of the lateral well bore 30 a short distance. Cement may then be pumped into the lateral well bore 30 and discharged adjacent to the packer 44 to form a cement plug 48. Thereafter, the drill rod 46 is withdrawn from the lateral well bore 30. In other instances, once the packer 44 has been disconnected, the drill rod 46 may be completely removed from the lateral well bore 30, and, thereafter, a tubing string, such as a working string or the drill string, including the drill rod 46, may be inserted into the lateral well bore 30 to pump cement adjacent to the packer 44.

A valve 50 is attached to an end of the conductor casing 21. In certain instances, the valve 50 may form part of well head or end piece 64 attached to the conductor casing 21. A sealing material 52 may be pumped into the lateral well bore 30. For example, the sealing material include one or more of a gel, such as poly acrylamide gel, a grout or cement, a urethane foam, such as a water-activated urethane foam (where water present in the lateral well bore 30 causes the urethane foam to activate and solidify), and/or other sealing material. Once injected, the sealing material 52 is maintained under pressure causing the material to permeate pores, cleats, fractures or other spaces in the subterranean zone 130 about the lateral well bore 30. The sealing material 52 also fills the lateral well bore 30. Consequently, once the sealing material 52 has set, the sealing material forms a seal, isolating the lateral well bore 30 from the subterranean zone 130 and the other well bores (e.g., main well bore 28 and other lateral well bores 26). The sealing material 52 may be maintained under pressure to ensure it has set. In certain instances, the sealing material 52 may be maintained under pressure for 24 to 48 hours. In certain implementations, the a cement plug can be omitted and the lateral well bore 30 filled entirely with the sealing material.

Figure 5:
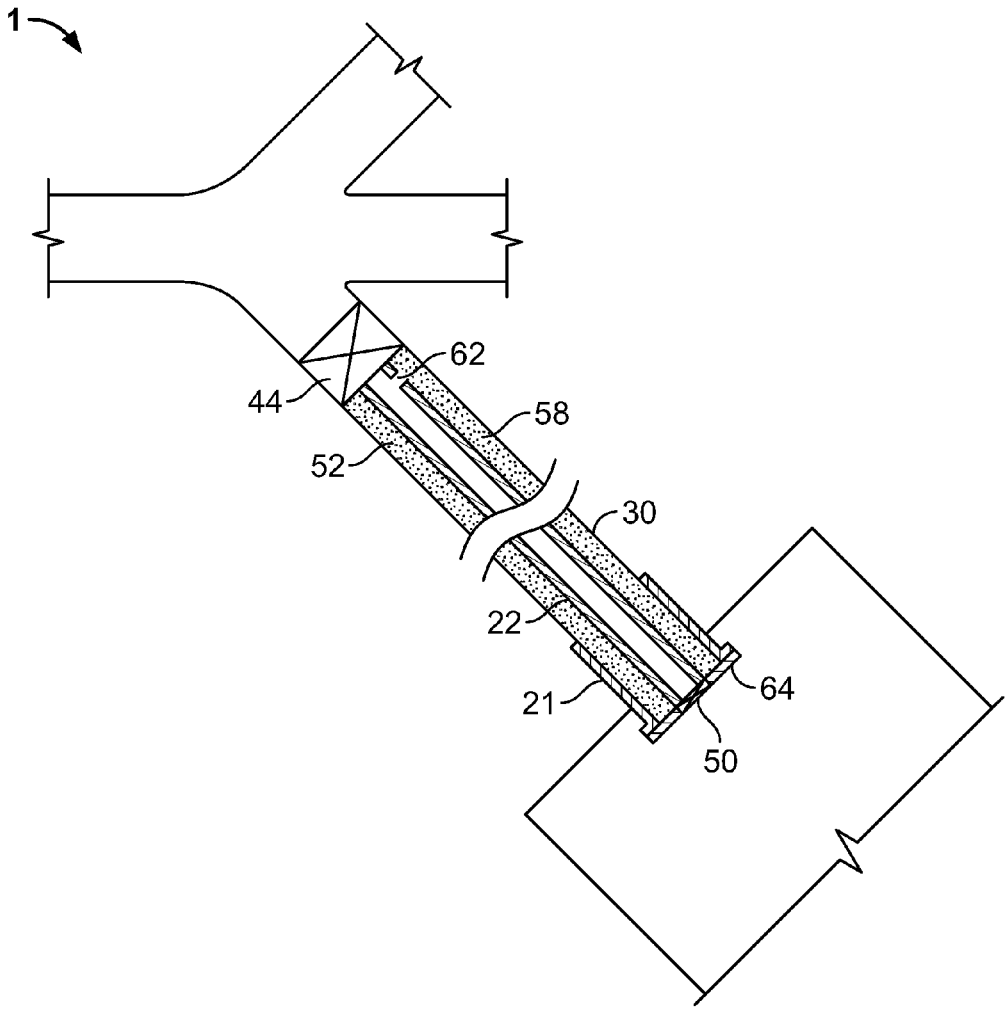
FIG. 5 is the lateral of FIG. 3 in a plugged condition according to other implementations.

As seen in FIG. 5, the packer 44 can be positioned using tubing 22, and the tubing 22 left in the lateral well bore 30 after the packer 44 is set in place. The tubing 22 may include a port 62 to provide communication between the tubing bore and the annulus 58. A sealing material 52, such as cement or other type described above, may be pumped through the tubing 22 and into the annulus 58 so as to fill the annulus 58. Additionally, the end piece 64 may include a relief valve to allow fluids displaced by the sealing material 52 to be evacuated from the lateral well bore 30. The tubing 22 may be retained in the lateral well bore 30 after the sealing material 52 is placed and allowed to solidify. Thus, the tubing 22 may be sacrificial. As above, the sealing material 52 may be maintained under pressure while it solidifies within the lateral well bore 30.

Figure 6:
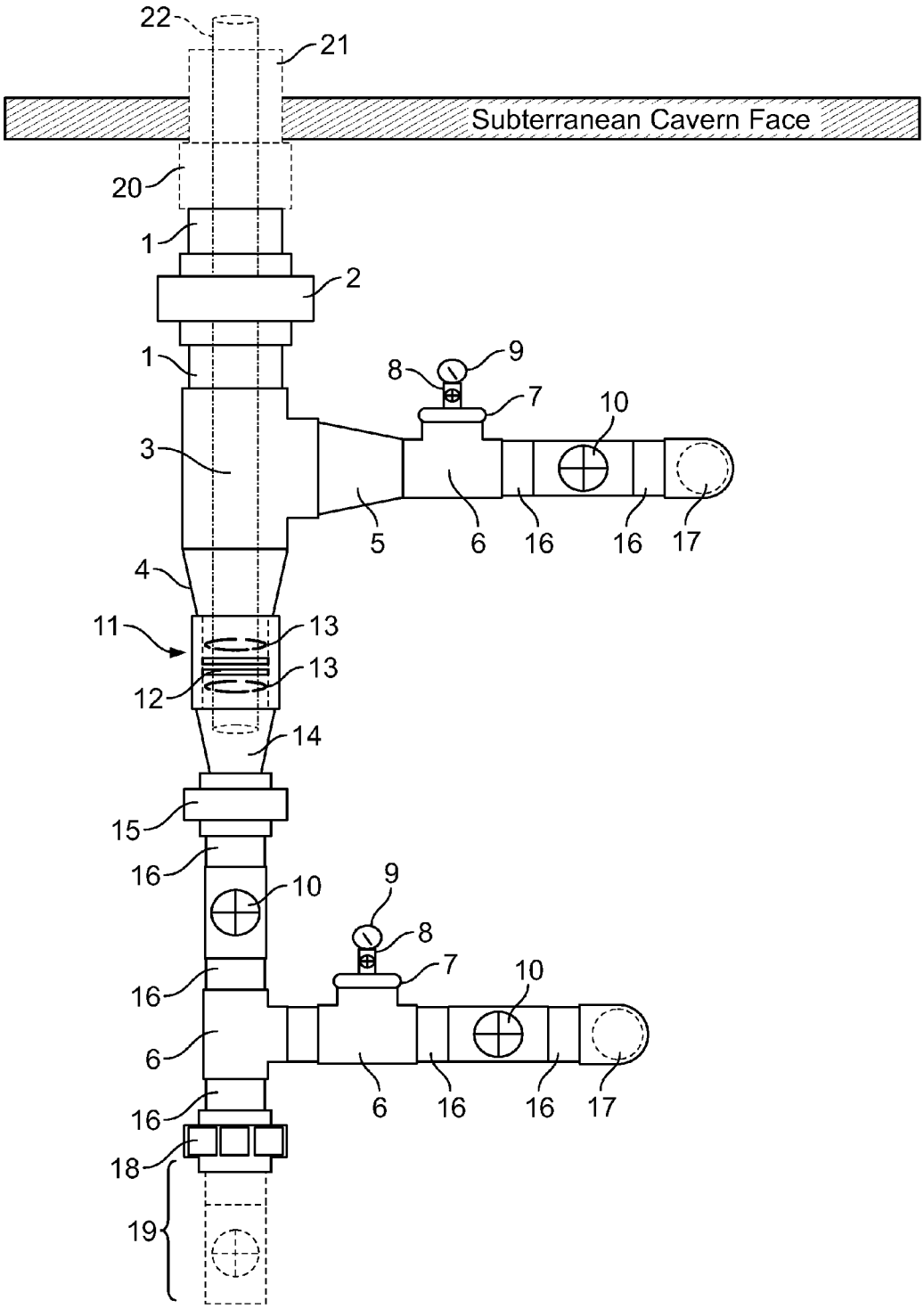
FIG. 6 is an example implementation of a end piece.

According to some implementations, the end piece 64 may include a well head manifold, identified by reference number 66, shown in FIG. 6. The well head 66 shown in FIG. 6 may include one or more of the components identified in Table 1. However, other implementations of the well head 66 may include different or other components.

TABLE 1

Components included in example implementation of the well head 66.
Equipment List

| Item | Description |
|---|---|
| 1 | 4 × 6 Std Nipple NPT |
| 2 | 4" FIG. 100 Hex Union |
| 3 | 4 × 4 × 4 Std Tee NPT |
| 4 | 4 × 3 Std Swage NPT |

TABLE 1-continued

Components included in example implementation of the well head 66. Equipment List

| Item | Description |
|---|---|
| 5 | 4 × 2 Std Swage NPT |
| 6 | 2 × 2 × 2 Std Tee NPT |
| 7 | 4 × 1/4" Std Bushing NPT |
| 8 | 1/4" Needle Valve |
| 9 | 1/4" 600# LF Gauge |
| 10 | 2" 1000# SP Ball Valve |
| 11 | 3" Std. Forged Collar |
| 12 | 1/2" Graphite Rope Packing |
| 13 | 3 × 2 Custom Built Washers |
| 14 | 3 × 2 Std Swage NPT |
| 15 | 2" FIG. 100 Hex Union |
| 16 | 2 × 4 Std. Nipple NPT |
| 17 | 2" Std. Trd. Ell NPT |
| 18 | 2" FIG. 100 Hammer Union |
| 19 | SDR 7 Poly Connections |
| 20 | 4" Sch. 80 PVC Collar GxNPT |
| 21 | 4" Sch. 80 PVC Pipe |
| 22 | 2" Sch. 80 PVC Pipe |

When the sealing material 52 has set, mining into the proposed mining area 32 may be continued. Consequently, mining may continue without having to completely shut in the well 100 and cease production of reservoir fluids from the remainder of the lateral well bores.

During continued mining, the mine 34 may again intersect the lateral well bore 30. In such circumstances, if voids are discovered in the previously injected sealing material or if the previously injected sealing material 52 is not effective at sealing the lateral well bore 30, additional sealing material 52 may be pumped into the lateral well bore 30. The sealing material 52 may fill voids present in the sealing material 52 previously injected. The additional sealing material 52 may be of the same type previously used or may be of a different type. For example, in certain instances, a water activated urethane foam may be used to fill voids in cement sealing material. The additional sealing material 52 can be pumped into the lateral well bore 30 from the new location of intersection. For example, a tubing can be inserted into the new location of intersection and sealing material 52 can be pumped into the lateral well bore 30 through the tubing. Alternately, the above-described process may be repeated if the mine 34 intersects the lateral well bore 30 beyond the location of the packer 44 or in another lateral well bore.

As indicated above, the flow of combustible gas into the well is a safety hazard. Therefore, the formation of a good seal by the packer 44 is important. To that end, once the packer 44 has been set, the seal formed by the packer 44 may be tested. Accordingly to some implementations, the seal may be tested by pumping water into the lateral well bore 30. The volume of water pumped into the lateral well bore 30 may be monitored until the lateral well bore 30 is filled and water begins to recirculate. An injection rate of the water and a return rate of the water after filling may also be monitored to determine if a proper seal has been formed. If the water injection and return rates are within acceptable parameters, the packer 44 is deemed to produce an adequate seal, and the isolation of the lateral well bore 30 may proceed. If the water injection and return rates are not within acceptable parameters, the packer may be unseated and relocated in the lateral well bore 30. The new seal may again be tested by the process described above. Also, according to some implementations, the sealing the lateral well bore 30 may be repeated if mining operations extend the mine 34 within 50 feet of the lateral well bore 30. Alternately or in addition to the water testing described above, a pressure test may be conducted to determine a sealing condition provided by the packer 44, such as by pressurizing the portion of the lateral well bore 30 between the packer 44 and the mine 34 to a selected pressure. If the pressure holds, the packer 44 may be deemed to adequately seal the lateral well bore 30.

As an additional safety precaution, a well fracturing tank filled, for example, with water, may also be placed at the surface and placed in communication with the lateral well bore 30. Thus, if an emergency condition is experienced, such as if an excess amount of formation fluid (e.g., natural gas) enters the well or if an excessive amount of oxygen is detected, the liquid in the fracturing tank may be released into the lateral well bore 30 and/or the well 100 to flood it and prevent an explosion or to counteract an explosion and/or fire that has already developed. In other instances, other fluids, such as inert and/or incombustible gasses or liquids, may be flooded into the lateral well bore 30 to confront a fire or explosion hazard.

During the plugging process described herein, reservoir fluids can continue to be collected through the remaining portion of the well bore pattern 24. In certain instances, the reservoir fluids produced during the plugging process may be flared at the surface and/or the fluids may be produced and sold. Further, the vacuum pump 36 may be operated during the entire plugging process, or the vacuum pump 36 may be switched off once the packer 44 has been placed into position and inflated. Also, although the plugging method is discussed in the context of forming a mine to recover underground resources, the process is equally applicable to forming other types of subterranean caverns.

Figure 7:
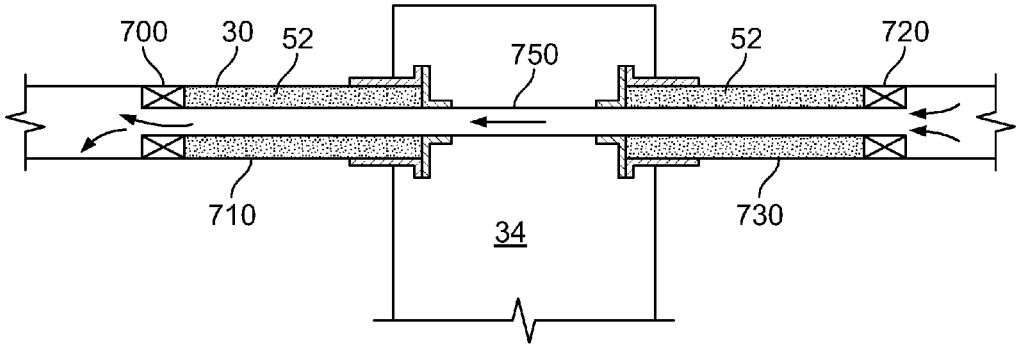
FIG. 7 shows a lateral well bore bisected by a mine.

FIG. 7 shows the well bore 30 bisected by the mine 34, severing the well bore 30 into two well bore sections in communication with the mine 34. In some instances, a first packer 700 disposed in a first well bore section 710 and a second packer 720 disposed in a second well bore section 730. Either and/or both of the well bore sections 710, 730 may be sealed as described above by setting packers 700 and/or 620 in the respective well bore sections 710, 730. A sealing material 52 may then be injected into either or both of the well bore sections 710, 730 and allowed to solidify. Sealing one or more of the well bore sections 710, 730 may be performed in a single-step (shown, for example, in FIG. 5) or a two-step process (shown, for example, in FIG. 4), as described above. Additionally, the packers 700 and 730 may include a pass-through openings 740 that are coupled to each other via a conduit 750. As a result, reservoir fluids may continue to be collected at the surface 14 from the first and second well bore sections 710, 730 of the well bore 30 while, concurrently, permitting continued excavation of the mine 34. In some instances, the collected reservoir fluids may be produced and sold while, in still other instances, the reservoir fluids may be flared or otherwise vented to the atmosphere.

Figure 8:
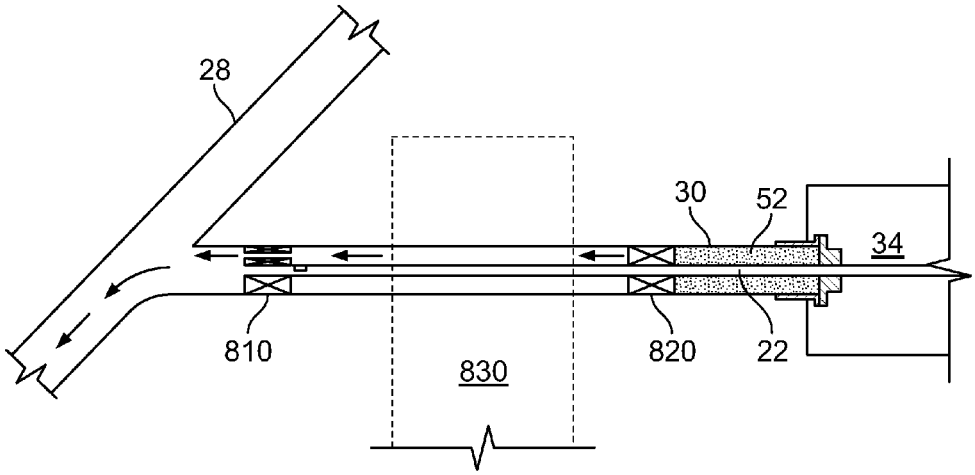
FIG. 8 shows a lateral well bore extending through the path of a future mine extension and intersected with a mine at another location.

FIG. 8 shows a further example system in which a well bore, such as the lateral well bore 30, intersects the mine 34. A first and second packer 810 and 820 may be set in the lateral well bore 30. One or both of the packers 810, 820 may be inserted into the lateral well bore 30 from the mine 34 or from the surface 120. The packers 810, 820 are set into place, and, as shown, the packers 810 and 820 may be separated to span a portion of the lateral well bore 30. A sealing material 52 may be injected into a portion of the lateral well bore 30 between the packer 820 and the mine 34 to form a seal. Tubing 22 may extend from the mine 34 through the packer 820 and to packer 810. A planned expansion of a portion of the mine 34 or a different mine is shown at 830. The planned expansion 830 may be performed at a time after intersection of the lateral well bore 30 and the mine 34. Until the expansion 830 is implemented and intersects the lateral well bore 30 as shown, the packer 810 may be of a type to provide communication with the surface 120, such as through the main well bore 28. Thus, reservoir fluids from the portion of the lateral well bore 30 may continue to be produced to the surface and, for example, sold or otherwise distributed for sale, flared, or otherwise released to the atmosphere.

Prior to intersection of the lateral well bore 30 by the expansion 830, the tubing 22 may be used to inject the section of the lateral well bore 30 between the packers 810 and 820, for example with one or more sealing materials 52, such as of a type described above. Alternately, a fluid, particularly an inert fluid, such as water, may be injected into the section of the lateral well bore 30 between the packers 810, 820. The sealing material 52 or other desired material may be injected into the span of the lateral well bore between the packers 810, 820 through the tubing 22 from the mine 34. The tubing may be disconnected from the packer 810, such as with a J-lock or other disconnecting mechanism, to introduce the sealing material 52 into the lateral well bore 30, or a blow-out port formed in the tubing 22 may be utilized to file the section of the lateral well bore 30. Thus, the expansion 830 can safely intersect the lateral well bore 30 between the packers 810, 820, substantially reducing or eliminating the risk of reservoir fluids entering the expansion 830.

Although the mine 34 or expansion 830 are shown as being perpendicular to the lateral well bore 30, the mine 34 or expansion 830 may be formed at any angle relative to the lateral well bore 30.

Figure 9:
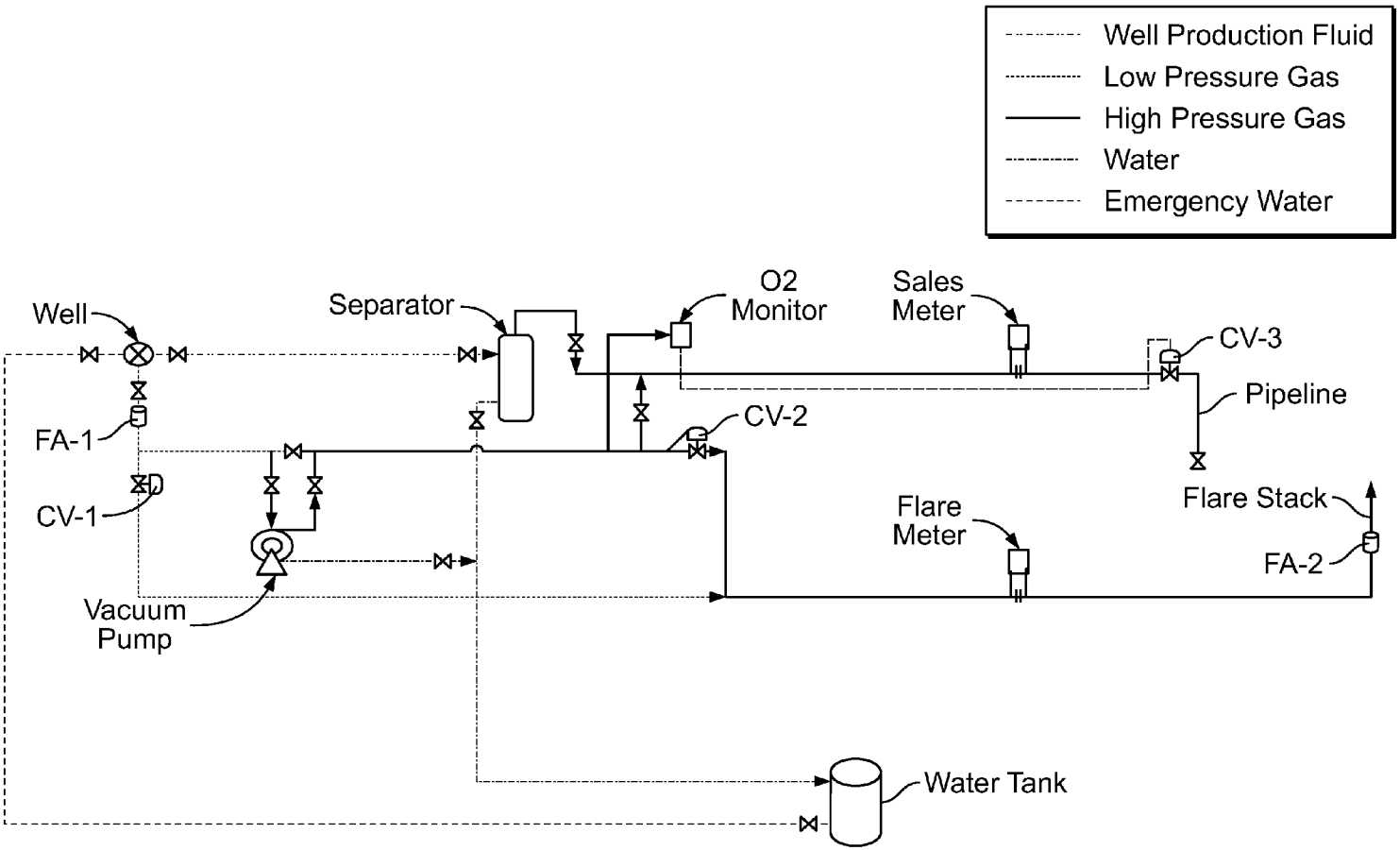
FIG. 9 is a schematic diagram of an example well production system according to some implementations of the present disclosure.

FIG. 9 illustrates a schematic diagram for an example well production system. According to some implementations the system components represented in FIG. 7 may be provided at or near the surface. As shown, the system may include a vacuum pump for generating a vacuum in the well, a separator for separating production fluids produced from the well into two or more components, an oxygen ($O_2$) monitor for monitoring an oxygen level in the production fluids, a flare stack for flaring all or a portion of the production fluids, and a flare meter for measuring an amount of the production fluids being flared. The production system may also include a sales meter for measuring an amount of production fluids being sold and transported to a pipeline for distribution and a water tank for flooding the well with a water or other fire suppression liquid, for example to prevent or counteract a fire or explosion within the well. The system may also include a plurality of adjustable valves for selectively controlling a flow of flooding liquid, production fluid, high pressure gas output from the vacuum pump, and low pressure gas directed to an input of the vacuum pump. The system of FIG. 9 is merely one example implementation of the well production system within the scope of the present disclosure. A description and example operating properties of the components shown in FIG. 9 are provided in Table 2, below.

TABLE 2

Example equipment list for an implementation of the well production system shown in FIG. 9.
Equipment List

| Item | Description & Example Operating Properties |
|---|---|
| FCV-1 | Pressure Reducing Regulator @ .1 PSIG |
| FCV-2 | Back Pressure Regulator @ 20-75 PSIG |
| FCV-3 | Fail Closed Motor Valve @ 90 PSIG |
| FA-1 | 316 SS Flame Arrester |
| FA-2 | CS Flame Arrester |

A number of implementations of the invention have been described. Nevertheless, it will be understood that various modifications may be made without departing from the spirit and scope of the disclosure. For example, although the configurations described herein are described with respect to a lateral well bore, application of the present disclosure to other well bores is also contemplated. Accordingly, other implementations are within the scope of the following claims.

What is claimed is:

1. A method of plugging a well bore comprising:
intersecting the well bore and a subterranean mine; and
depositing a seal through the intersection of the well bore and subterranean mine from the subterranean mine to isolate a portion of the well bore;
wherein depositing a seal through the intersection of the well bore and subterranean mine to isolate a portion of the well bore comprises inserting a packer into the portion of the well bore from the subterranean mine.

2. The method of claim 1 further comprising expanding a perimeter of the portion of the well bore.

3. The method of claim 2, wherein expanding the perimeter of the portion of the well bore comprises:
inserting a plug into the well bore from the subterranean mine;
enlarging the perimeter of the portion of the well bore; and
removing the plug from the well bore through the subterranean mine.

4. The method of claim 2 further comprising casing an expanded portion of the well bore.

5. The method of claim 1 further comprising fixing the packer into a desired location within the portion of the well bore.

6. The method of claim 5, wherein fixing the packer into a desired location within the portion of the well bore comprising inflating the packer to form a seal.

7. The method of claim 1, wherein depositing a seal through the intersection of the well bore and subterranean mine to isolate a portion of the well bore comprises injecting a sealing material into the portion of the well bore from the subterranean mine.

8. The method of claim 7 further comprises pressurizing the injected sealing material within the well bore.

9. The method of claim 1, wherein depositing a seal through the intersection of the well bore and subterranean mine to isolate a portion of the well bore comprises:
portioning the well bore to form the portion of the well bore;
injecting a first sealing material into the portion of the well bore to form a plug; and
injecting a second sealing material into the portion of the well bore adjacent to the plug.

10. The method of claim 9, wherein the first sealing material and the second sealing material are different.

11. The method of claim 1, wherein the well bore is a horizontal multi-lateral well bore.

* * * * *